United States Patent [19]

Leling et al.

[11] Patent Number: 4,711,606

[45] Date of Patent: Dec. 8, 1987

[54] SHAPED (CONCRETE) BLOCK FOR RETAINING WALLS AND ALSO A RETAINING WALL

[75] Inventors: Menno Leling, Bremen; Gerhard Hagenah, Worpswede, both of Fed. Rep. of Germany

[73] Assignee: SF-Vollverbundstein-Kooperation GmbH, Bremen, Fed. Rep. of Germany

[21] Appl. No.: 824,804

[22] Filed: Jan. 31, 1986

[30] Foreign Application Priority Data

Feb. 18, 1985 [DE] Fed. Rep. of Germany ..... 3505530
Nov. 4, 1985 [EP] European Pat. Off. ..... 85114011.1

[51] Int. Cl.[4] ..... E02D 29/02

[52] U.S. Cl. ..... 405/286; 52/593; 52/608; 405/284

[58] Field of Search ..... 405/284, 285, 286, 289, 405/258, 33; 52/590, 593, 605, 608, 609

[56] References Cited

U.S. PATENT DOCUMENTS

| | | | |
|---|---|---|---|
| 789,730 | 5/1905 | Hinton | 52/605 |
| 3,488,964 | 1/1970 | Kubo | 405/33 |
| 3,953,979 | 5/1976 | Kurose | 405/286 |
| 4,193,718 | 3/1980 | Wahrendorf et al. | 405/262 |
| 4,490,075 | 12/1984 | Risi et al. | 405/286 |
| 4,512,685 | 4/1985 | Hegle | 405/284 |
| 4,524,551 | 6/1985 | Scheiwiller | 405/286 |
| 4,601,148 | 7/1986 | Risi et al. | 52/596 |

FOREIGN PATENT DOCUMENTS

| | | | |
|---|---|---|---|
| 21449 | 1/1981 | European Pat. Off. | 405/286 |
| 39372 | 11/1981 | European Pat. Off. | 405/286 |
| 951372 | 3/1964 | United Kingdom | 405/33 |

*Primary Examiner*—David H. Corbin
*Attorney, Agent, or Firm*—Sughrue, Mion, Zinn, Macpeak & Seas

[57] ABSTRACT

A retaining wall (20) of shaped blocks (22) arranged one above the other in layers (43, 58, 62) is defined with respect to the stability by the seating width and the core cross-section determined from the latter. By maximizing seating surfaces (27, 38 . . .) of the shaped blocks resting one above the other, the seating width which is a decisive factor for determining the core cross-section is considerably increased.

14 Claims, 13 Drawing Figures

SHAPED (CONCRETE) BLOCK FOR RETAINING WALLS AND ALSO A RETAINING WALL

DESCRIPTION

Figure 1:
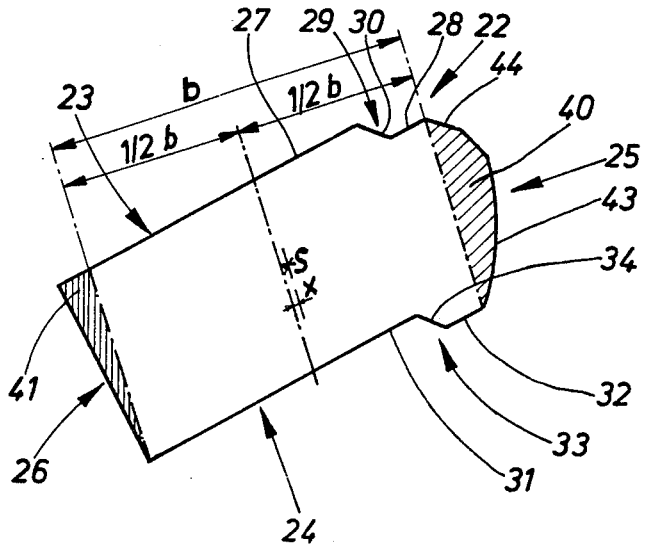

The invention relates to a shaped block of concrete for making a retaining wall which is inclined relative to the vertical towards an earth backfill and consists of shaped blocks which are arranged one above the other in layers and are in engagement with one another at their upper side and under side by projections and recesses. The invention also relates to a retaining wall of such shaped blocks.

It is the object of the present invention to develop further and improve technically and aesthetically shaped blocks of the above embodiment and retaining walls made from the shaped blocks. In particular, large design heights of the retaining walls are also to be made possible in the case of shaped blocks of the same size and in the case of the same technical preconditions.

To achieve this object, the shaped blocks according to the invention are characterized in that their upper side and their under side of the same each have at least two seating surfaces which are offset step-like relative to one another and run parallel to one another.

The offset formed in this way of the seating surfaces on the upper side and under side is made such that the seating surfaces on the atmosphere side are at a lower level than the seating surfaces on the earth side. The seating surfaces offset relative to one another are connected to one another by an inclined stop surface, namely sloping towards the atmosphere side.

By this configuration of the shaped blocks, an increase in the statically effective seating area is surprisingly achieved and is also maintained when the shaped blocks are displaced slightly relative to one another. Such slight relative displacements often cannot be avoided in practice when building up the shaped block, that is, when erecting the retaining wall.

Since the seating surfaces run directly up to the front side and the rear side of the shaped blocks, a statically effective seating width results which is only slightly smaller than the length of the shaped block (dimension across the longitudinal extension of the supporting wall). The static axis of a shaped block or of a supporting wall formed therefrom runs through the centre of the seating width. According to the invention, the seating surfaces of the shaped block are arranged at an oblique angle to the static axis, with an obtuse angle being formed on the earth side and an acute angle being formed on the atmosphere side relative to the static axis.

Particularly advantageous is a shaped block in which three or more parallel seating surfaces are formed on the upper side—and correspondingly on the under side—of which the seating surface on the earth side extends at a higher level than the center seating surface and this in turn extends at a higher level than the seating surface on the atmosphere side, with, moreover the seating surface on the earth side and the seating surface on the atmosphere side being approximately the same size and the centre seating surface being considerably larger than the seating surface on the earth side and the seating surface on the atmosphere side. The three (or more) seating surfaces accordingly adjoin one another in a cascade shape—rising from the atmosphere side to the earth side—by the arrangement of inclined stop surfaces between adjacent seating surfaces.

By means of a shaped block of the above embodiment, a plurality of configuration possibilities of the (gravity) retaining walls is provided. The shaped blocks can be built up in layers with one another in a laterally reversed manner with respect to the earth side and atmosphere side. However, the formation of retaining walls having a stepped width or depth by the arrangement of two or more shaped blocks next to one another in a transverse direction to the longitudinal extension of the retaining walls is particularly advantageous. Lower wall bases which are made steplike in cross-section are consequently formed which considerably increase the design height or loading capacity of the retaining walls. In the area of the transition from one stepped portion of the retaining wall to the other, the shaped blocks which are adjacent in height are offset relative to one another and are in alternate positive engagement with one another (keying).

According to a further feature of the invention, the shaped blocks, on the earth side and the atmosphere side, are provided with head portions which adjoin a bearing portion formed by the seating surfaces and can be formed (differently) in corresponding manner for decoration, for better sound absorption or for keying to the earth.

Figure 2:
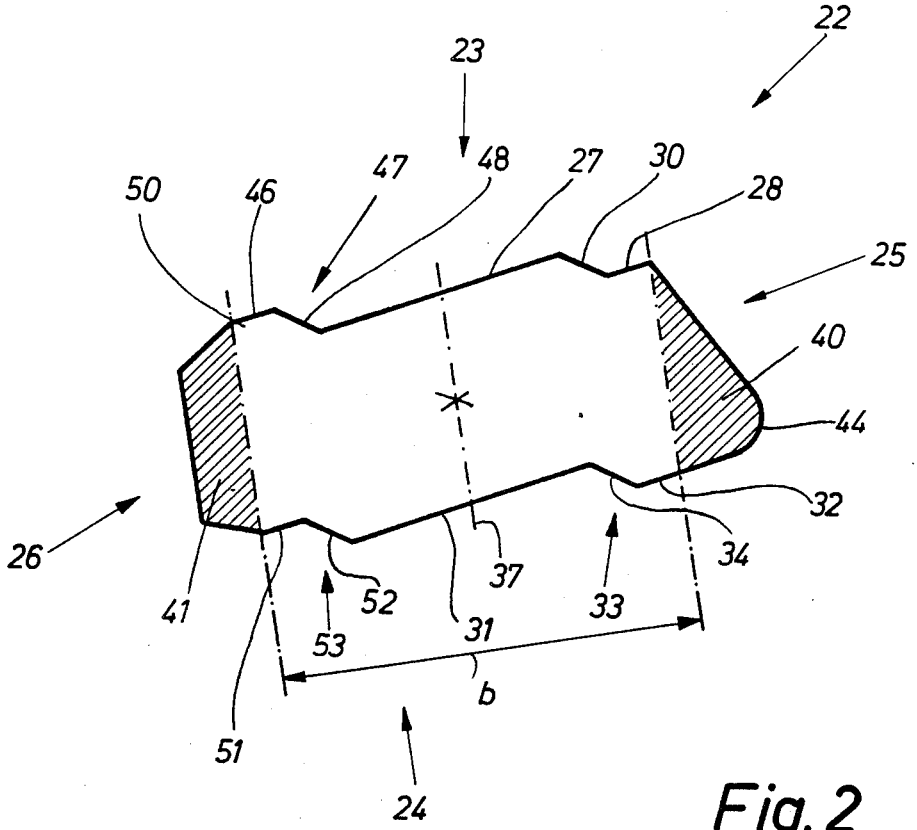
Figure 3:
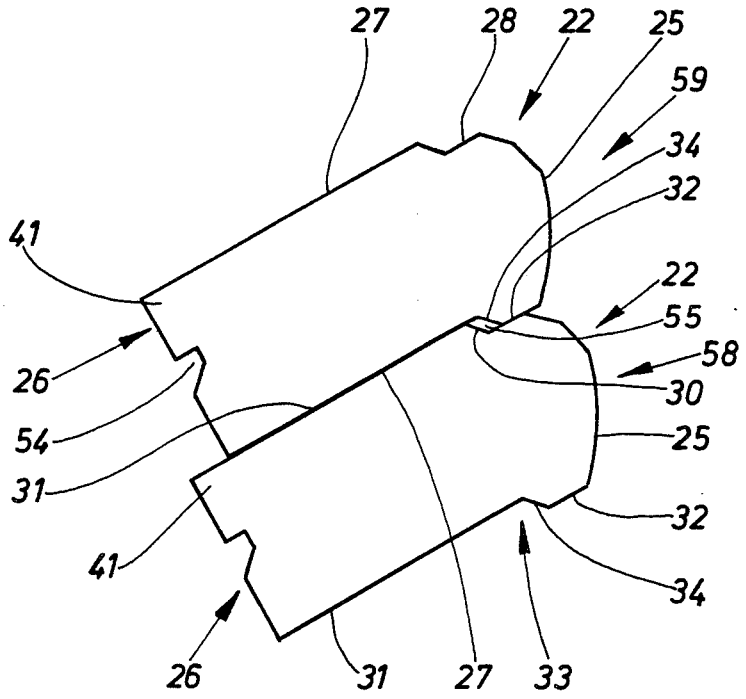
Figure 5:
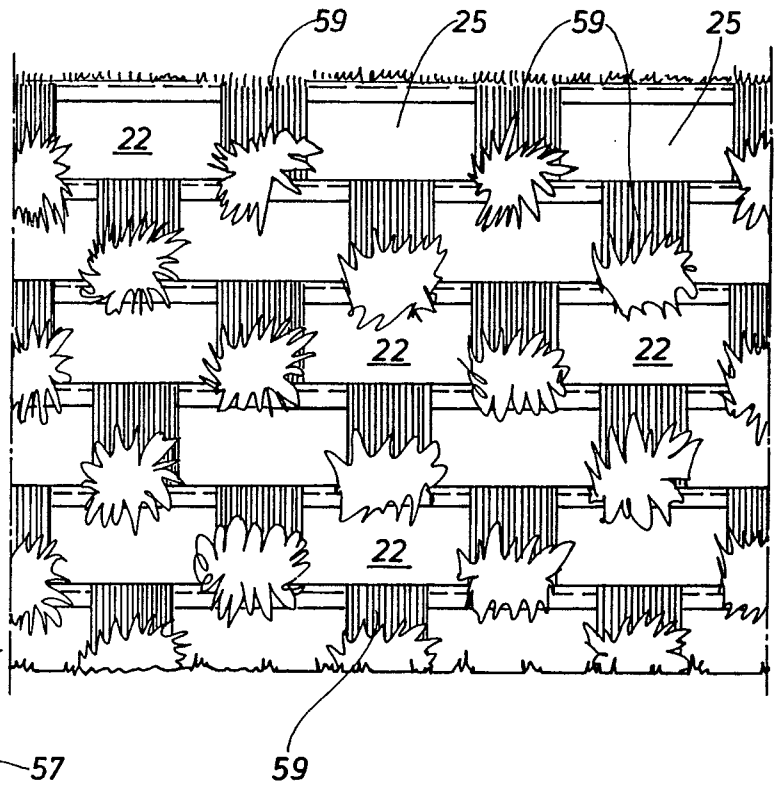
Figure 4:
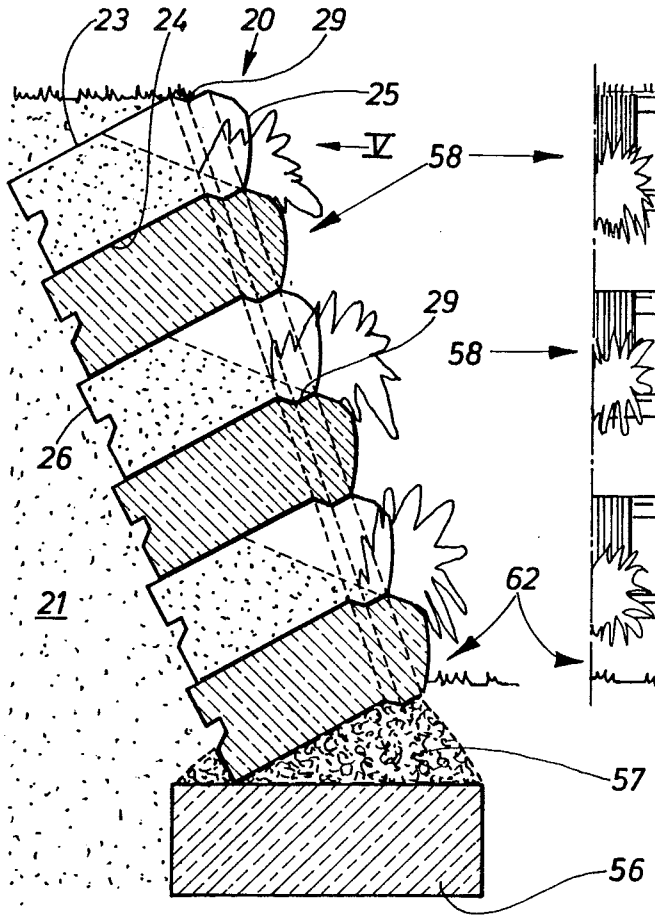
Figure 6:
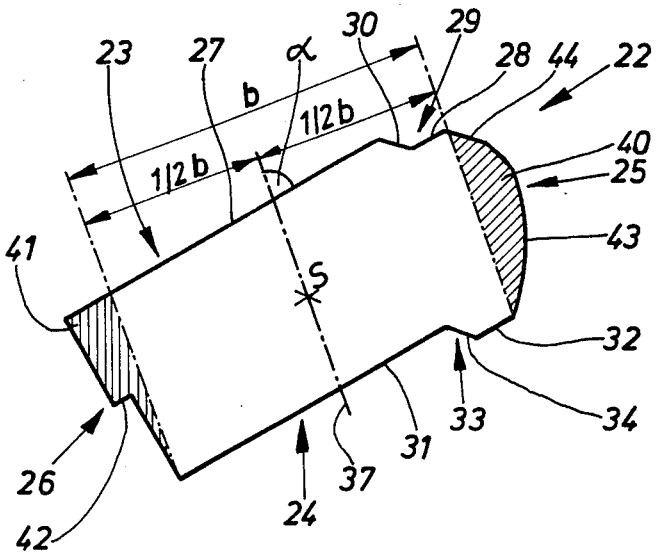
Figure 7:
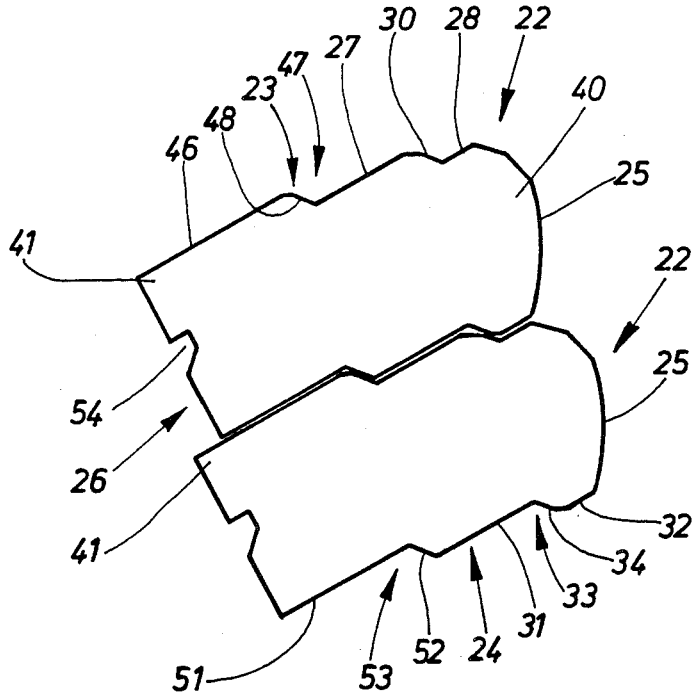
Figure 8:
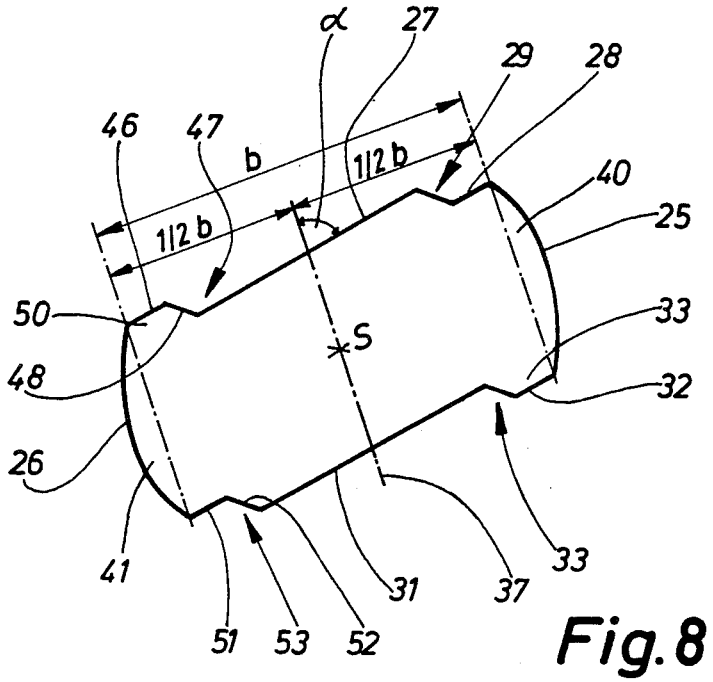
Figure 9:
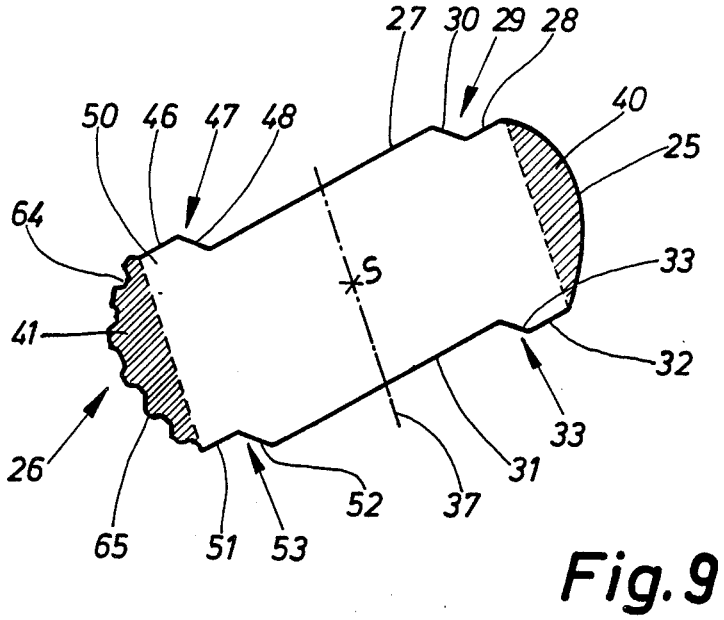
Figure 11:
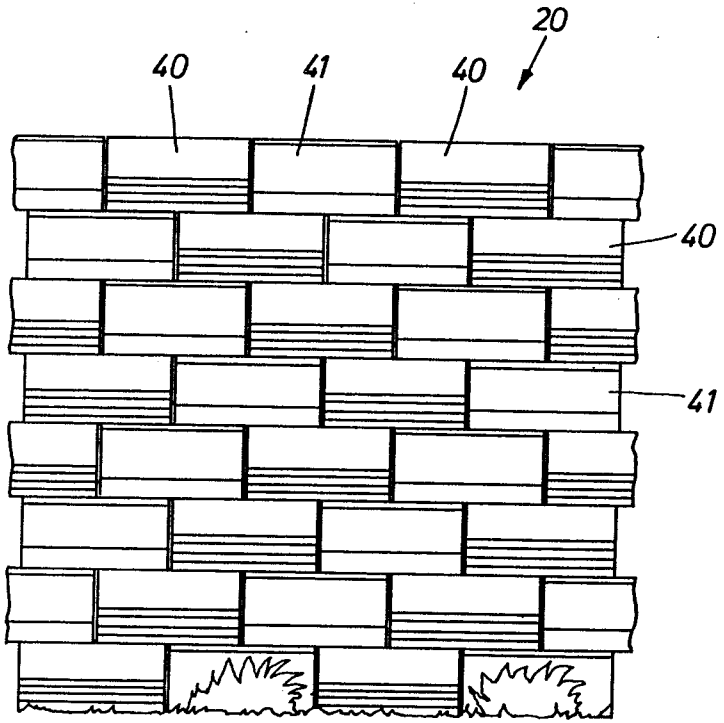
Figure 10:
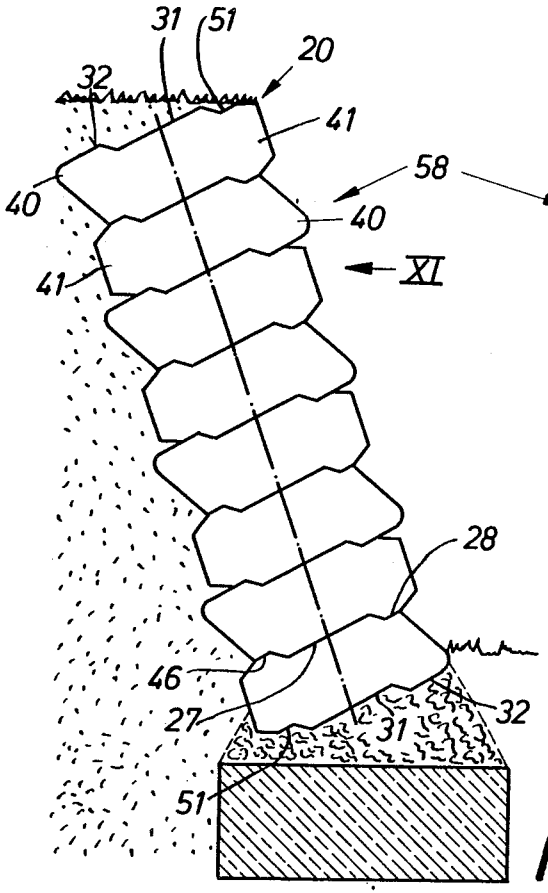
Figure 12:
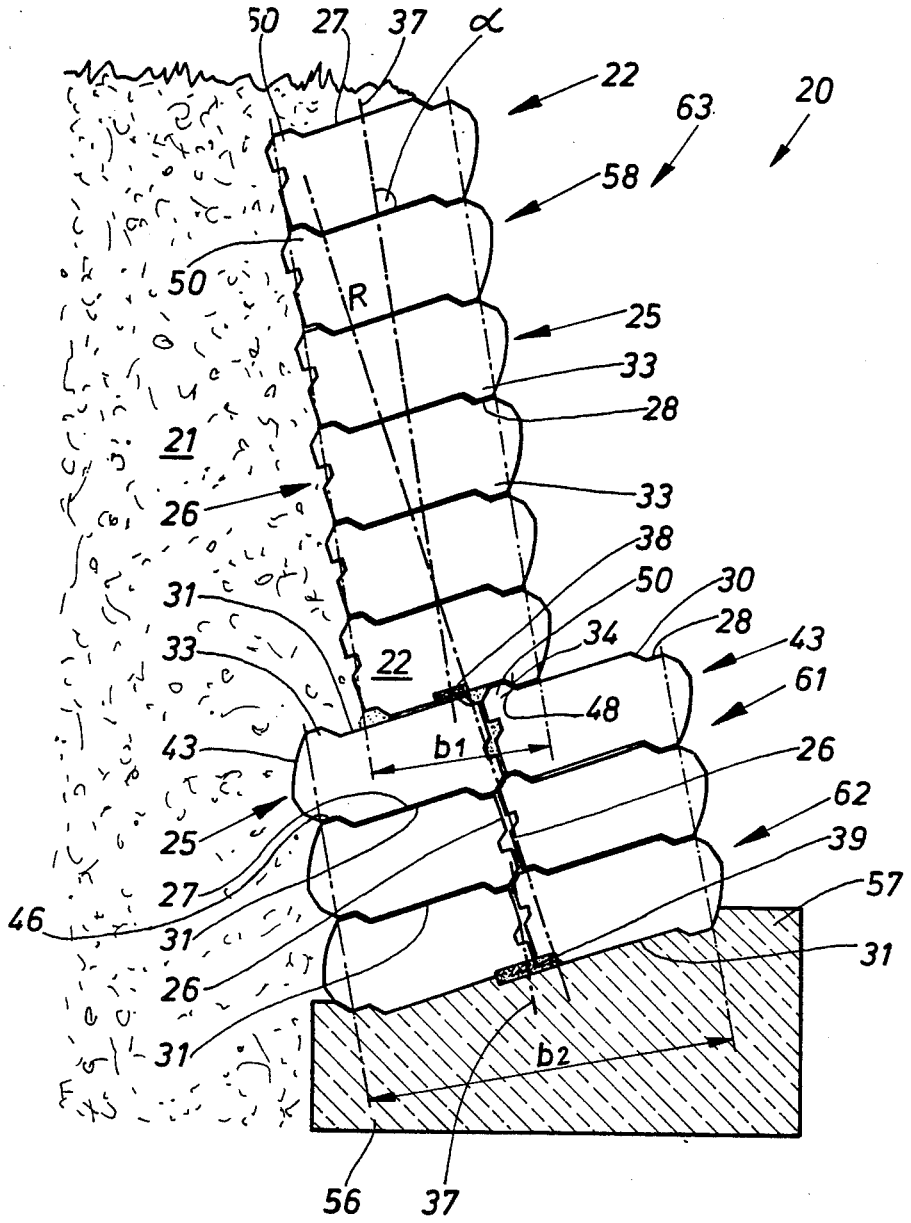
Figure 13:
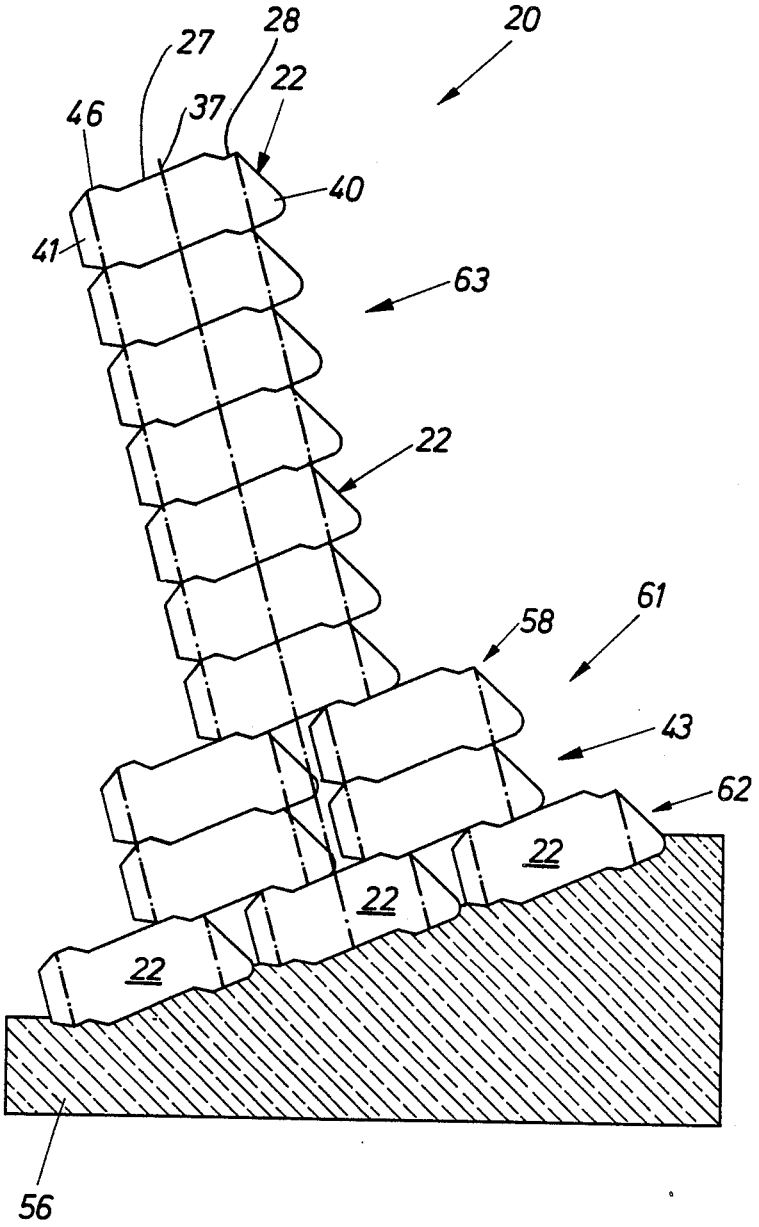

Further particulars of the shaped block according to the invention and of the retaining wall are described in greater detail below with reference to the drawings, wherein:

FIG. 1 shows a side view of a shaped block,

FIG. 2 shows another preferred illustrative embodiment of a shaped block, also in side view, FIG. 3 shows a side view of two shaped blocks of another embodiment in correct positional arrangement above one another, FIG. 4 shows a vertical section of a retaining wall formed from shaped blocks according to FIG. 3, FIG. 5 shows a front or longitudinal view of the retaining wall according to FIG. 4, FIG. 6 shows a side view of a further illustrative embodiment of a shaped block, FIG. 7 shows a side view of two shaped blocks of a further illustrative embodiment in correct positional arrangement, FIG. 8 shows a side view of a further illustrative embodiment of a shapd block, FIG. 9 shows a side view of a universally applicable embodiment of a shaped block, FIG. 10 shows a vertical section of a cutaway portion of a retaining wall of shaped blocks according to FIG. 2, FIG. 11 shows a front view of a section of a retaining wall according to FIG. 10, FIG. 12 shows a side view and vertical section of a retaining wall with variable effective cross-section, FIG. 13 shows another illustrative embodiment of a retaining wall, made step-shaped, of shaped blocks according to FIG. 2.

The illustrative embodiments of shaped blocks shown in the drawings are used for making retaining walls, namely dry gravity retaining walls 20 having an earth backfill 21 on one side. The retaining wall 20 is arranged in a plane inclined towards the earth backfill. The angle of the retaining wall 20 relative to the horizontal is preferably between 60° and 70°.

The illustrative embodiments of shaped blocks 22 shown in the drawings form an upper side 23, an under side 24, a front side 25 on the atmosphere side and a rear side 26 facing towards the earth backfill 21. In all illustrative embodiments, the upper side 23 and the under side 24 are formed in corresponding manner to one another in such a way that a matching, positive superimposition of the shaped blocks 22 within the retaining wall 20 is guaranteed.

To achieve optimum static relationships, the upper side 23 and under side 24 consist of at least two seating surfaces 27 and 28 which extend in planes displaced vertically relative to one another and always run parallel to one another. The seating surface 28 facing towards the atmosphere side—in the shaped block lying horizontally—is stepped downwards, relative to the seating surface 27 at the earth side, by the formation of a step 29 having a stop surface 30 which in the present case is inclined. The stop surface 30 is arranged such that it slopes towards the atmosphere side, for example at an angle of about 45° to the two seating surfaces 27 and 28.

Corresponding hereto, a seating surface 31 at the earth side and a seating surface 32 at the atmosphere side are also formed on the under side 24 and are likewise aligned parallel to one another and parallel to the upper seating surfaces 27 and 28. For the positive mutual engagement with an adjacent lower shaped block, the seating surface 32 at the atmosphere side is offset downwards in the same way by the formation of a step 33 which is formed by an inclined stop surface 34.

Because of the steps having stop surfaces on the upper side 23 and the lower side 24, elevations and depressions, which are made such that they are matched to one another, develop in the area of the superimposed surfaces of the shaped blocks 22 which positively interlock in self-centering manner.

If the shaped blocks 22 are properly laid one above the other, the seating surfaces 27 and 28 and also the stop surface 30 sit in full surface contact against the allocated seating surfaces 31 and 32 and the stop surface 34 of the adjacent shaped block. In this way, a seating width b comes statically into effect which corresponds to the sum of the seating and stop areas (see e.g. FIG. 6). The seating width b is decisive for the loading capacity or permissible design height of the retaining wall 20. A static axis 37 of the shaped block or the retaining wall extends in the center of the seating width b. In the illustrative embodiments shown, the shaped blocks 22 are designed such that the static axis 37 is aligned at an oblique angle to the upper and lower seating surfaces 27 and 31, and in fact in such a way that an acute angle on the upper side of the shaped block 22 faces towards the atmosphere side. The retaining wall 20 is preferably arranged such that it is inclined towards the earth backfill 21 in an angular range of 60° to 70° of the static axis 37. This results in the seating surfaces 27 and 28 and also 31 and 32 always running at a slope to the earth backfill 21, whereas the stop surfaces 30 and 34 also extend at a slope to the atmosphere side. The above mentioned surfaces consequently have a self-centering action for the shaped blocks 22 arranged one above the other.

The seating width b of the shaped block 22 or the retaining wall 20 as a whole is statically of particular importance. A force resultant R arising from the inherent weight of the retaining wall 20 and the earth pressure as a result of the earth backfill 21 must run within a core cross-section 38 and 39 of the retaining wall 20 because of static specifications, and in fact in each case in the area of the lower shaped block 22. This statically relevant core cross-section 38 and 39 is 1/6th of the seating width b. It extends centrally, that is with equal dimensions, on both side of the static axis 37. A large seating width b results in a correspondingly large core cross-section 38 and 39. The retaining wall 20 can have a correspondingly greater design height.

Moreover, a statically interesting factor is the centre of gravity S of the shaped block 22; for, outside the contact surface of the shaped blocks 22, shaped block areas available to the seating width b affect the position of the centre of gravity S. In the illustrative embodiment of FIG. 1, a head 40 projecting beyond the seating width b is formed on the atmosphere side, which head 40 is defined on the outside by the front side 25. The weight or the mass of this head 40 (hatched in FIG. 1) displaces the centre of gravity S towards the atmosphere side. In the illustrative embodiment of FIG. 1, a smaller extension 41 which is triangular in cross-section acts in the opposite direction in the area of the earth side.

In the illustrative embodiment according to FIG. 6, the extension 41 is designed with a mass of equal size to the head 40. Consequently, the centre of gravity S is located exactly on the static axis 37. Moreover, a step 42 is formed in the area of the rear side 26, which step 42 increases, on the one hand, the roughness of the shaped block and, on the other hand acts as a grip for grasping the same.

The shaped blocks 22 can be provided with more than two seating surfaces and steps on the upper side 23 and the under side 24. In the illustrative embodiment of FIG. 2, a further third seating surface 46 is formed on the earth side, which seating surface 46, according to the design principle of the shaped blocks in the horizontal position of the same, extends at a higher level than the adjacent (larger) seating surface 27. Between the two is formed a step 47 having an inclined stop surface 48. In the present case, an extension 41 having a trapezoidal cross-section adjoins on the earth side, so that the seating surface 46 is part of an edge-side projection 50 having a trapezoidal cross-section.

A corresponding seating surface 51 having a stop surface 52 is formed on the under side, and therefore also has a step 53. The upper side and under side are correspondingly made cascade shaped in this manner, rising on the upper side 23 towards the earth side. The centre seating surface 27 and 31 is large compared with the seating surfaces 28 and 46 and 32 and 51 respectively, which are of the same size.

In this particularly advantageous shaped block 22, the front side 25 consists of a head 40 which is triangular in cross-section and has a lower round edge 44. The lower plane of the head 40 extends in an elongation of the seating surface 32, but is not an active constituent part of the latter, because the head 40 is outside the seating width b. The cross-section areas of the head 40 and extension 41 are the same size, so that the centre of gravity S lies in the area of the static axis 37.

FIG. 7 shows a variant in which three seating surfaces 27, 28 and 46 are likewise formed on the upper side. However, the latter seating surface 46 is of greater length than in the previously described illustrative embodiment. The greater number of extensions 29, 33, 47 and 53 on the upper side 23 and the under side 24 produces a more favourable keying of the shaped blocks with one another. The smooth-surface rear side 26 of these shaped blocks is provided with a formed-in recess 54 which can act as a grip recess.

FIG. 8 shows a shaped block 22 having a specular-symmetric design such that the shaped blocks can be laid without considering the front side and the rear side, because both sides are made identical, in the present case curved, that is, spherical. The shaped block is provided in each case with three seating surfaces 27, 28, 31, 32 and 46 and 51 on the upper side and lower side. The seating surfaces 46 and 51 facing towards the earth backfill 21 are of the same size as the seating surfaces 28 and 32 on the atmosphere side. The height of the steps 29, 33, 47 and 53 is also identical, so that the shaped blocks can be laid within the retaining wall 20 with their sides turned through 180°. The center of gravity S in this equi-sided design lies on the static axis 37.

The arrangement of seating surfaces which are always parallel and, as in the illustrative embodiment shown, of stop surfaces arranged parallel to one another, results in the effective seating width b not being changed in noticeable manner, even with slight displacements of the shaped blocks relative to one another, which in practice cannot be completely ruled out when erecting the retaining wall. As shown in FIG. 3 to a greatly increased scale, a gap 55 of one or of a few millimetres arises merely in the area of the step 29 and 33. The stable, statically perfect seating of the shaped blocks is nonetheless maintained.

FIG. 9 shows a shaped block 22 which corresponds in principle to the design according to FIG. 8. This means that the head 40 and the extension 41 are made essentially identical, so that this shaped block can be built in laterally reversed. The front side and/or rear side—in the illustrative embodiment shown the rear side 26—are provided with a structured surface. Here, this concerns grooves 64 which run in the longitudinal direction or horizontally and are essentially of trapezoidal cross-section. These are separated from one another by correspondingly formed ribs 65.

Retaining walls having a different external appearance can be formed from a shaped block 22 designed in this way, and in fact by using only one type of shaped block (FIG. 9), and in fact by laying the shaped blocks with the structured surfaces alternately facing towards the atmosphere side and the earth side.

FIGS. 4 and 5 show the arrangement of shaped blocks 22 in a retaining wall 20, which is constructed in the normal way and can be planted, on a continuous concrete foundation 56 having a wedge-shaped compensating piece 57, for determining the inclination. The shaped blocks 22 are laid at a distance from one another and staggered within individual layers 58, so that intermediate spaces 59 are produced for plants. In the present configuration of the shaped blocks, this enables the earth to be brought up to the front side 25 of the shaped block 22 (angle of slope 60° in FIG. 4).

FIG. 12 shows a retaining wall 20 having a variable effective cross-section. In the lower area, a wall base 61 consists of several layers 43 of shaped blocks located next to one another across the longitudinal extension of the retaining wall 20, and in fact in the embodiment according to FIG. 3, but having a third seating surface 46 on the upper side, as in the illustrative embodiment of FIG. 2 or FIGS. 8 and 9. The (smooth) rear sides 26 are turned towards one another within the layers 43. In the area of the wall base 61 or a lower foundation layer 62, this results in a seating width $b_2$ which arises from the seating surfaces of the two shaped blocks 22 of the foundation layer 62, which shaped blocks 22 are each located next to one another. Moreover, the shaped blocks 22 arranged one above the other are in alternate positive engagement as a result of the projections 50 on the one hand and the oppositely located step 53 on the other hand. The arrangement is made such that the shaped blocks on the earth side are each arranged laterally reversed with respect to the upper side 23 and the under side 24. In the area of a vertical centre plane, this results in a meander-shaped keying of the superimposed shaped blocks located next to one another. Two adjacent shaped blocks of the layer 43 and 62 each form a recess into which a projection 50 can enter in matching manner.

Above the wall base 61, a wall upper part 63 consists of layers 58 having in each case a shaped block in the direction perpendicular to the plane of the retaining wall 20. A statically favourable, namely relatively wide core cross-section 38 and 39 is available in the area of the foundation layer 62 and the transition from the wall upper part 63 to the wall base 61.

The lower shaped block 22 of the wall upper part 63 is supported by the lower stop surface 34 against the upper stop surface 48 of the front shaped block of the wall base 61. Consequently, a self-centering relative position of the shaped blocks is also available in this area. The number of the layers 58 and 62 in the area of the wall base 61 is selected such that the lower core cross-section 39 is utilized as a result of the given factors of the upper core cross-section 38 and the direction of the resultant R.

The retaining wall according to FIG. 13 is constructed in similar manner, namely with a wall base 61 and wall upper part 63. In this illustrative embodiment, the base layer 62 consists of three shaped blocks 22 adjoining one another in the direction perpendicular to the plane of the retaining wall 20. By the configuration of the shaped blocks according to the illustrative embodiment of FIG. 2 and by the relative arrangement of the same, a self-centering support is also created here relative to the foundation layer 62 in the area of the transition of the wall upper part 63 to the wall base 61 and the layer 43 consisting of two shaped blocks.

In this retaining wall 20 of shaped blocks of the preferred embodiment of FIG. 2, an optimum positive keying of shaped blocks is provided in the area of the respective cross-sectional enlargement of the retaining wall, that is, in the area of the upper layer 58 to the wall upper part 63 and from the lower layer 43 to the foundation layer 62. Two shaped blocks of a layer are overlapped by a shaped block of an adjacent layer (here layer 58 on the one hand and foundation layer 62 on the other hand), which shaped block is located in an offset position, and in fact by the engagement of the steps and recesses in one another in the sequence of a cascade-shaped configuration. Such a wall can be highly loaded or made to a considerable design height.

The shaped blocks can be of any suitable or useful size. In an advantageous embodiment according to FIGS. 1 and 2, the overall length of the shaped blocks from the front side 25 to the rear side 26 is about 30 cm. The height of such a shaped block, that is, the distance of the seating surfaces 27 and 31 from one another, is for example about 15 cm. In one illustrative embodiment, the steps, that is, the distance of the parallel seating surfaces from one another, is 2.5 cm. The width of the small seating surfaces 28, 32 . . . is favourable at 3.5 cm.

We claim:

1. A shaped block of concrete for making a retaining wall (20) which is inclined, relative to the vertical, towards an earth backfill, and which consists of shaped blocks which are arranged one above the other in layers and which have upper sides and under sides in engagement with one another, characterized in that:

the upper side (23) of the shaped block has three parallel planar seating surfaces (27,28,46) and two stop surfaces (30,48);

the seating surfaces of the upper side (23) comprise a main surface (27) and smaller first and second surfaces (28,46) at first and second ends of the block and lying in planes equally displaced below and above the plane of the main surface (27);

the stop surfaces (30,48) of the upper side (23) extend, respectively, between the main surface (27) and the first end surface (28) of the upper side (23) and between the main surface (27) and the second end surface (46) of the upper side (23);

the under side (24) of the shaped block has three parallel planar seating surfaces (31, 32, 51) and two stop surfaces (34,52);

the seating surfaces of the under side (24) comprise a main surface (31), extending parallel to the main seating surface (27) of the upper side (23), and smaller first and second end surfaces (32,51) at the first and second ends of the block and lying in planes equally displaced below and above the plane of the main surface (31) of the under side (24) to the same extent that the first and second end surfaces (28,46) of the upper side (23) are displaced from the plane of the main surface (27) of the upper side (23); and the stop surfaces (34,48) of the under side (24) extend, respectively, between the main surface (31) and the first end surface (32) of the under side (24) and between the main surface (31) and the second end surface (52) of the under side (24), and are separated from each other to the same extent as the stop surfaces (30,48) of the upper side (23).

2. Shaped block according to claim 1, characterized in that each stop surface (30, 34, 48, 49, 52) slopes toward the atmosphere side of the retaining wall (20) and runs to an angle particular in particular below 45°.

3. Shaped block according to claim 1, characterized in that the seating surface (28, 32) facing towards the atmosphere side is arranged in a deeper location relative to the seating surface (27, 31) on the earth side and is small compared with the seating surface on the earth side.

4. Shaped block according to claim 2, characterized in that the stop surfaces (30 . . . ) have a small width compared with the seating surface (27) on the earth side or at the centre, and consequently have small height compared with the overall height of the shaped block (22).

5. Shaped block according to claim 1, characterized in that the earth-side seating surface (46) on the upper side (23) extends at a higher level than the centre seating surface (27) and the latter extends at a higher level than the seating surface (28) on the atmosphere side, with the seating surface (46) on the earth side and the seating surface (28) on the atmosphere side being made approximately the same size, and the centre seating surface (27) being considerably larger than the seating surfaces on the earth and atmosphere sides.

6. Shaped block according to claim 1, characterized in that the seating surfaces (27..51) and the stop surfaces (30, 34..) define a seating width b, from which extends a head (40) on the atmosphere side and an extension (41) on the earth side.

7. Shaped block according to claim 6, characterized in that the head on the atmosphere side is made triangular in cross-section and has a lower plane in elongation of the adjacent lower seating surface (32) and an outer round edge (44), and that the extension (41) on the earth side is made trapezoidal in section.

8. Shaped block according to claim 6, characterized in that the sectional areas of the head (40) and the extension (41) are made to the same size.

9. Shaped block according to claim 6, characterized in that the head (40) together with the atmosphere side (25), and the extension (41) together with the earth side (26), are made identical, in particular arched in a curved (circular) shape.

10. Shaped block according to claim 1, characterized in that the front side (25) and/or the rear side (26) are provided with a surface structure, in particular having grooves (64) and ribs (65) running in the longitudinal direction or horizontally, preferably having a trapezoidal cross-section.

11. Retaining wall of shaped blocks according to claim 1, with the shaped blocks (22) being arranged one above the other in layers, in particular by the formation of gaps between shaped blocks within a layer, which shaped blocks are adjacent in the longitudinal direction of the retaining wall, characterized in that a wall base (61) of several, in particular two, shaped blocks, arranged next to one another in the transverse direction to the longitudinal extension of the retaining wall (20), is formed in a lower part of the retaining wall (20), which part is adjacent to a (concrete) foundation (56).

12. Retaining wall according to claim 11, characterized in that, by corresponding relative arrangement on the upper side of second shaped blocks (22) adjacent transversely to the longitudinal extension of the retaining wall (20), the shaped blocks (22), in the area of the wall base (61), in the centre area on their upper side, are in positive engagement with shaped blocks (22) of the layer (58) arranged above the latter, which shaped blocks (22) are located in an off-set position.

13. Retaining wall according to claim 11, characterised in that, in the area of the wall base (61), lower layers (43 or 62) consist of three or more shaped blocks (22) which are arranged next to one another transversely to the longitudinal extension of the retaining wall, the shaped blocks of the individual layers having a varying number of shaped blocks arranged next to one another in offset manner in such a way that the seating surfaces and the stop surfaces facing towards one another are in positive engagement with one another.

14. Retaining wall according to claim 11, characterized in that the seating surfaces (27 . . . 51) and the stop surfaces (30,34 . . . ) define a seating width b from which extends a head (40) on the atmosphere side and an extension (41) on the earth side, and in that the blocks in alternating first and second layers are arranged with their head portions (40) facing the atmosphere in the first layers, and with their extension portions (41) facing the atmosphere in the second layers.

* * * * *